US006077137A

United States Patent [19]

Hahn

[11] Patent Number: 6,077,137

[45] Date of Patent: Jun. 20, 2000

[54] ANTI INGESTION DEVICE

[75] Inventor: Douglas E. Hahn, Virginia Beach, Va.

[73] Assignee: Volvo Penta of the Americas, Inc., Chesapeake, Va.

[21] Appl. No.: 09/227,333

[22] Filed: Jan. 8, 1999

[51] Int. Cl.[7] ..... B63H 21/38

[52] U.S. Cl. ..... 440/89; 60/324

[58] Field of Search ..... 440/88, 89; 60/324

[56] References Cited

U.S. PATENT DOCUMENTS

| | | | |
|---|---|---|---|
| 1,038,685 | 9/1912 | Titus et al. . | |
| 3,552,121 | 1/1971 | Kitagawa et al. | 440/89 |
| 3,759,041 | 9/1973 | North et al. . | |
| 3,921,398 | 11/1975 | Kashmerick | 440/89 |
| 4,178,873 | 12/1979 | Bankstahl | 440/89 |
| 4,326,374 | 4/1982 | Streb | 440/89 |
| 4,526,002 | 7/1985 | Bibow | 440/89 |
| 4,887,692 | 12/1989 | Outani et al. | 440/89 |
| 5,644,914 | 7/1997 | Deavers et al. | 440/89 |

*Primary Examiner*—Jesus D. Sotelo
*Attorney, Agent, or Firm*—Michael J. Bell; Howrey Simon Arnold & White, LLP

[57] ABSTRACT

An anti ingestion device for use with an engine, preferably a marine engine. The device comprises an exhaust manifold or riser system for exhausting engine gases, wherein the exhaust manifold has a first end and a second end, and the first end is connected to a cylinder head. There is a one-way pressure relief valve having a first end and a second end, wherein the first end is coupled to the exhaust manifold and the second end is exposed to atmospheric pressure. An air inlet line is coupled to the second end of the one-way pressure relief valve, such that the air inlet line serves as a conduit for guiding atmospheric pressure to the one-way pressure relief valve, thereby providing atmospheric pressure for passage into the exhaust manifold.

6 Claims, 3 Drawing Sheets

ANTI INGESTION DEVICE

BACKGROUND OF THE INVENTION

1. Field of the Invention

The present invention relates in general to marine engines and more particularly to exhaust systems for marine engines.

2. Description of the Related Art

Marine engines typically use water-cooled exhaust systems in which water already circulated through the engines cooling system is utilized to cool exhaust pipes and to lower engine compartment temperatures. To accomplish this, most marine engines use double walled pipes with the exhaust passing through the inside pipe and the spent cooling water flowing in the cavity between the two pipes. At some point in the system the inner wall terminates and the water and exhaust mix and exit the exhaust system together. It is important that the water and exhaust particles exit the system rather than being ingested into the engine to prevent the phenomenon known as hydro-locking. Hydro-locking is essentially the ingestion of water into the cylinders of the engine. Since the water can not be compressed or ignited, the pistons essentially "lock up" and the engine seizes.

In an internal combustion engine, air and exhaust move in an unsteady manner due to many factors such as intake and exhaust valves opening and closing, differing throttle positions, continually changing pressures and temperatures in the engine, intake and exhaust system shape and flow patterns. The conventional nomenclature for this phenomenon is "unsteady gas dynamics".

Within the ducting or tubing system of internal combustion engines there are two types of finite-amplitude waves that can occur, a compression wave and an expansion wave. A compression wave is always a positive pressure wave with greater pressure than atmospheric pressure and an expansion wave has lower pressure than atmospheric pressure. Compression waves always move particles in the direction of their propagation and expansion waves always move particles in the direction opposite their propagation. Pressure waves and particle waves do not necessarily move at the same speed.

In an internal combustion engine, when the exhaust valve is opened and the piston is on the exhaust stroke, a compression wave is formed that moves from the exhaust valve toward the end of the exhaust pipe and subsequently into the atmosphere. As the compression wave leaves the exhaust pipe a reflected expansion wave is formed that moves back toward the exhaust valve. As explained previously, this expansion wave moves particles opposite the direction of wave travel so the particle flow is toward the open end of the pipe or outlet end of the exhaust system into the atmosphere.

In an optimally tuned internal combustion engine, both the compression waves and expansion waves can effect and contribute to exhaust particle movement. In the case of marine engines, these waves contribute to move the mixture of spent cooling water and exhaust gas particles as they travel within the exhaust system out of the exhaust system. Therefore, in an internal combustion engine, it can be said that exhaust gas particles and spent cooling water move out of an internal combustion engine exhaust pipe to the underwater environment due to the phenomenon that compression waves will move particles in the direction of propagation and expansion waves will move particles in the direction opposite their propagation. This phenomenon occurs in a pipe with openings at both ends (i.e. with an exhaust pipe open to the underwater environment at one end and with a valve open to the combustion chamber at the other end).

In correctly designed internal combustion operation, at steady state conditions, the expansion waves may propagate towards the exhaust valve when it is open. The negative pressure expansion wave actually enhances combustion cylinder exhaust flow during the exhaust stroke when the negative pressure condition encounters the positive pressure being generated by the piston action. This allows the gas particles to continue to move out of the engine, toward the end of the exhaust pipe, and then into the atmosphere. This phenomenon is basically balanced in the engine when running at quasi steady state (i.e. when acceleration or deceleration is not radical).

However when the throttle is snapped shut quickly from high rpm there is a "lag" time in the exhaust system where previously created expansion waves are traveling. During this lag time the exhaust valve is not open in concert with the returning expansion waves. In this condition the exhaust valve behaves like a closed end pipe and the expansion waves reflect and change direction. This change in direction changes the direction of both the expansion negative pressure wave and the gas particle movement. Instead of the gas particles moving toward the atmosphere (against the expansion wave) via the end of the exhaust pipe, they move toward the closed exhaust valve (again in the opposite direction of the expansion wave). Moreover, when the expansion wave reaches the end of the pipe (and thus the atmosphere) it reflects back as a compression wave moving opposite the desired direction. Both waves then drive particle flow back towards the exhaust valve. This phenomenon will cause gas particles and water in the exhaust stream to move towards the manifold, valve and cylinder into the previously dry exhaust pipe. If the engine is accelerated or decelerated (typically only decelerated) quickly causing a reverse of the desired gas dynamics, there is potential for sufficient water to be introduced into the exhaust manifold whereby a hydro-locking of the engine could occur. Such an occurrence can result in severe or catastrophic engine failure.

Marine engine manufacturers have not designed a fully capable solution to this problem and boat owners are normally faced with replacing engines that have ingested water in such a manner. Current design techniques increase the height of the exhaust riser in an effort to have more suction head in the riser than is produced by the negative pressure wave. This does not address the basic problem of water ingestion, but only creates a greater distance for the water to travel before entering the exhaust valve. Another technique is to form a sudden change in the cross sectional area of the exhaust pipe just after the water and exhaust mix in an effort to reflect the expansion wave back to the open exhaust end, prior to water and particle flow reaching the exhaust valve area. These methods have had limited success in the past, mostly due to the limitations in engine compartment height available from boat manufacturers and insufficient area available for wave reflection.

Another problem that is encountered by boat owners is that when a carbureted engine is turned off, the act of turning the key to the off position opens the circuit to the ignition coil thus eliminating the spark to the spark plug. The engine then coasts down to a stop. During this coast down period, air and fuel are still drawn through the engine and raw fuel and air are drawn into the intake system into the cylinder then expelled into the exhaust system. Often, due to low octane fuel or a hot spot in the combustion chamber, the engine will "diesel" or run backwards just prior to coming to a stop. The engine can run backwards for several revolutions until the raw fuel in the exhaust system is spent. While the engine is running backwards, the exhaust system assumes the role of an intake system and the air in the exhaust system is pulled back into the cylinder along with the water in the exhaust system, thereby causing the engine to be hydro-locked.

Accordingly, there is a need in the art for an anti ingestion device which can be used in conjunction with an internal combustion engine to reliably prevent the back flow of water and particles into the intake manifold.

SUMMARY OF THE INVENTION

Accordingly, the present invention is directed to an anti ingestion device. It is a principal advantage of the present invention to prevent the back flow of water and foreign particulate matter into an engine.

Additional features and advantages of the invention will be set forth in the description that follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention consists of an anti ingestion device for use with an engine, preferably a marine engine. The device comprises an exhaust manifold and an exhaust riser system for exhausting engine gases, wherein the exhaust manifold has a first end and a second end, and the first end is connected to a cylinder head. There is a one-way pressure relief valve having a first end and a second end, wherein the first end is coupled to the exhaust manifold or the exhaust riser and the second end is exposed to atmospheric pressure. An air inlet line is coupled to the second end of the one-way pressure relief valve, such that the air inlet line serves as a conduit for guiding atmospheric pressure to the one-way pressure relief valve, thereby providing atmospheric pressure for passage into the exhaust manifold.

It is an object of the present invention to provide a device for preventing the back flow of water and foreign particulate matter into a marine engine.

It is another object of the present invention to provide a device for preventing the back flow of water and foreign particulate matter into a marine engine whereby the device does not effect the pressure within the combustion section of the engine.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
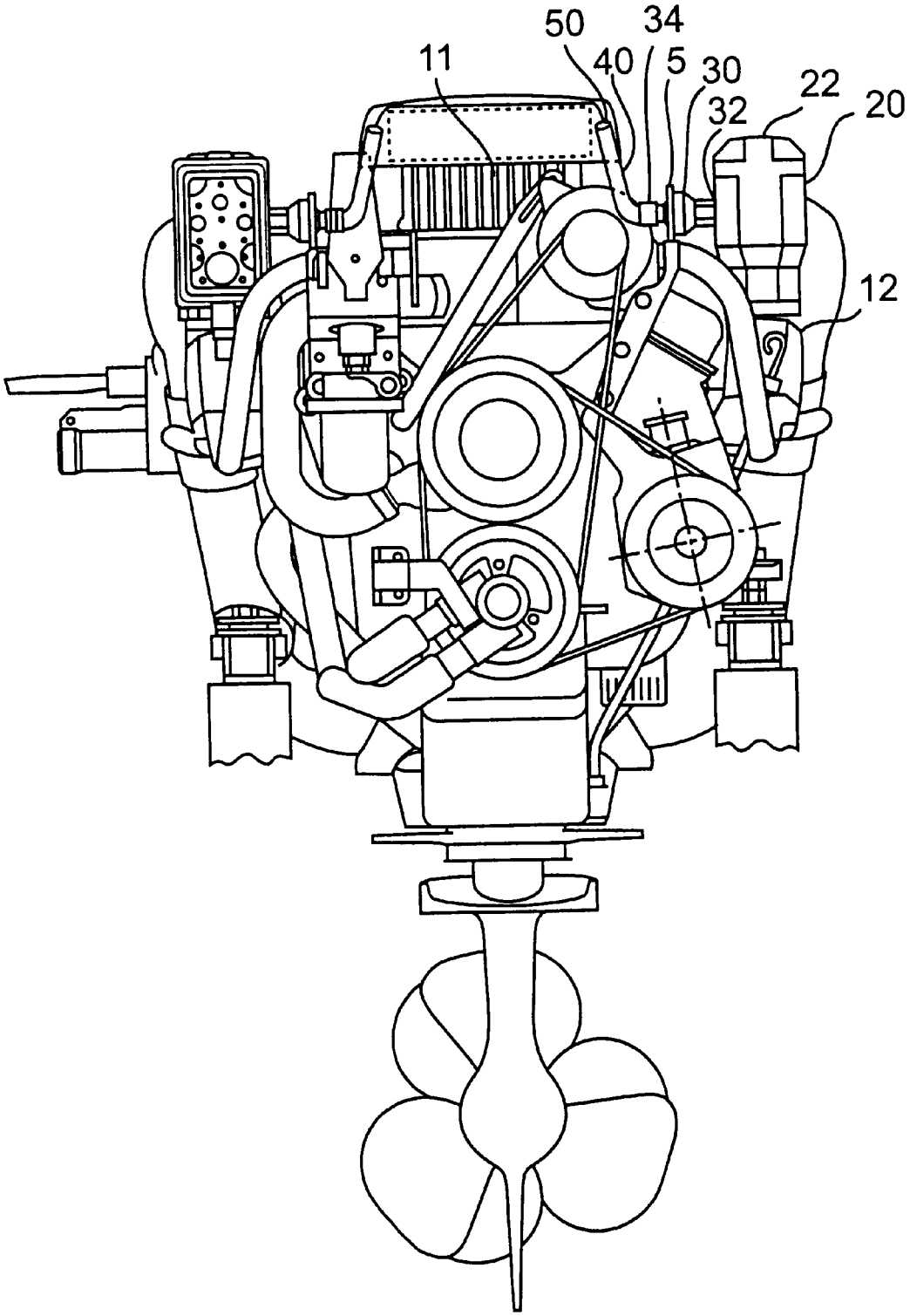
FIG. 1 is a front view of a marine engine with the anti ingestion device according to the present invention.
Figure 2:
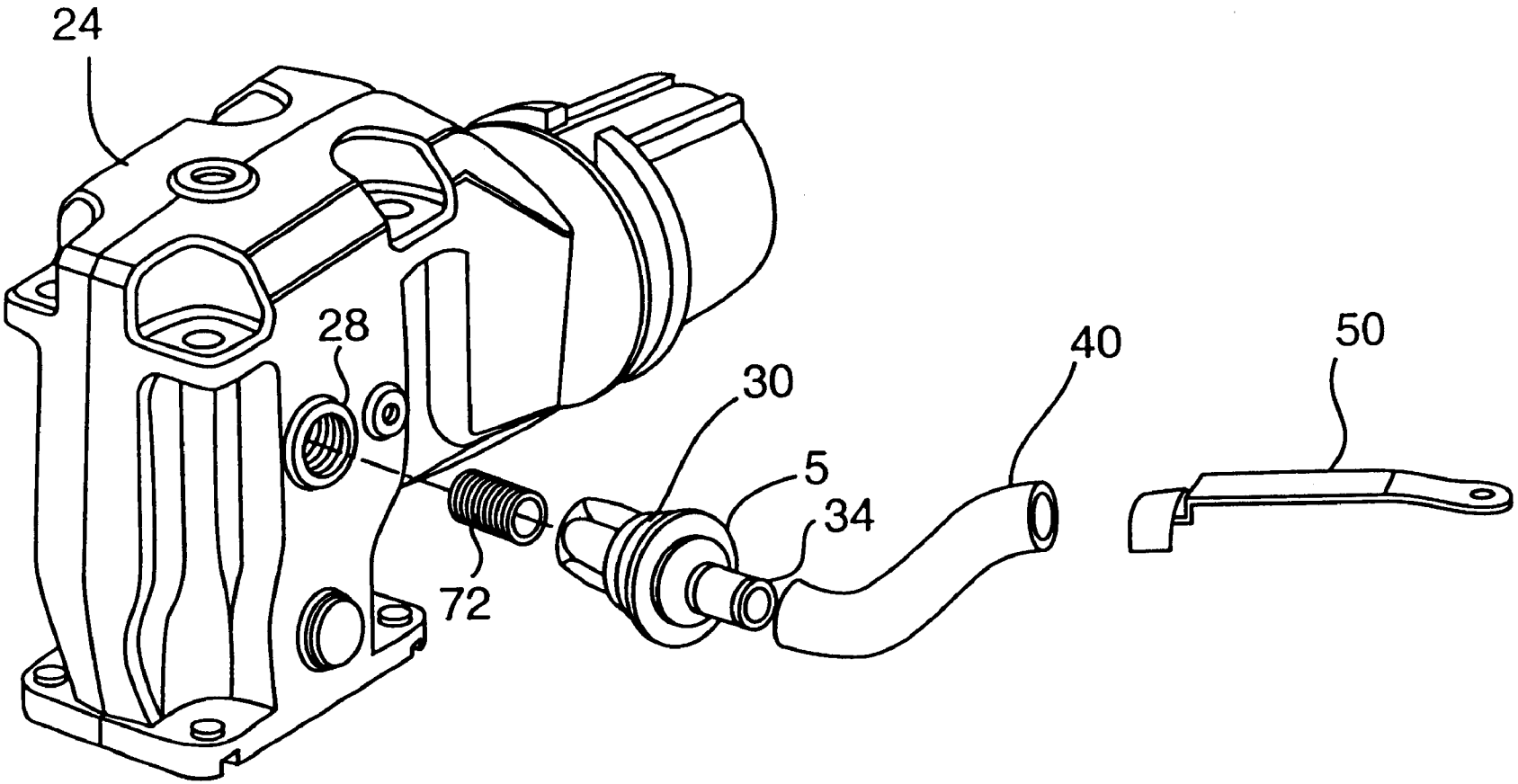
FIG. 2 is an exploded view of the anti ingestion device according to the present invention.

The exemplary embodiment of the anti ingestion device is shown in FIGS. 1 and 2 and is designated generally by reference numeral 5. As embodied herein and referring to FIGS. 1 and 2, the anti ingestion device 5 is attached to a marine engine 10 into the exhaust manifold 20, or alternatively into the exhaust riser system, having a first end or intake 22 and a second end or outlet 24 for exhausting engine gases, a one-way pressure relief valve 30 having a first end or outlet 32 and a second end or inlet 34, and an air inlet line 40. The marine engine 10 and its exhaust manifold 20 can be of any variety, but is preferably cooled by fresh or water circulating through the engine block and cylinder head 12.

The first end 22 of the exhaust manifold 20 is connected to the cylinder head 12. It is preferred that the first end 32 of the one-way pressure relief valve 30 is coupled to the exhaust manifold 20 and the second end 34 is exposed to atmospheric pressure. Alternatively, the first end 32 of the one-way pressure relief valve 30 is coupled to the exhaust riser. There is preferably an air inlet line 40 coupled to the second end 34 of the one-way pressure relief valve 30, such that the air inlet line 40 serves as a conduit for guiding atmospheric pressure to the one-way pressure relief valve 30, thereby providing atmospheric pressure for passage into the exhaust manifold 20.

Figure 3:
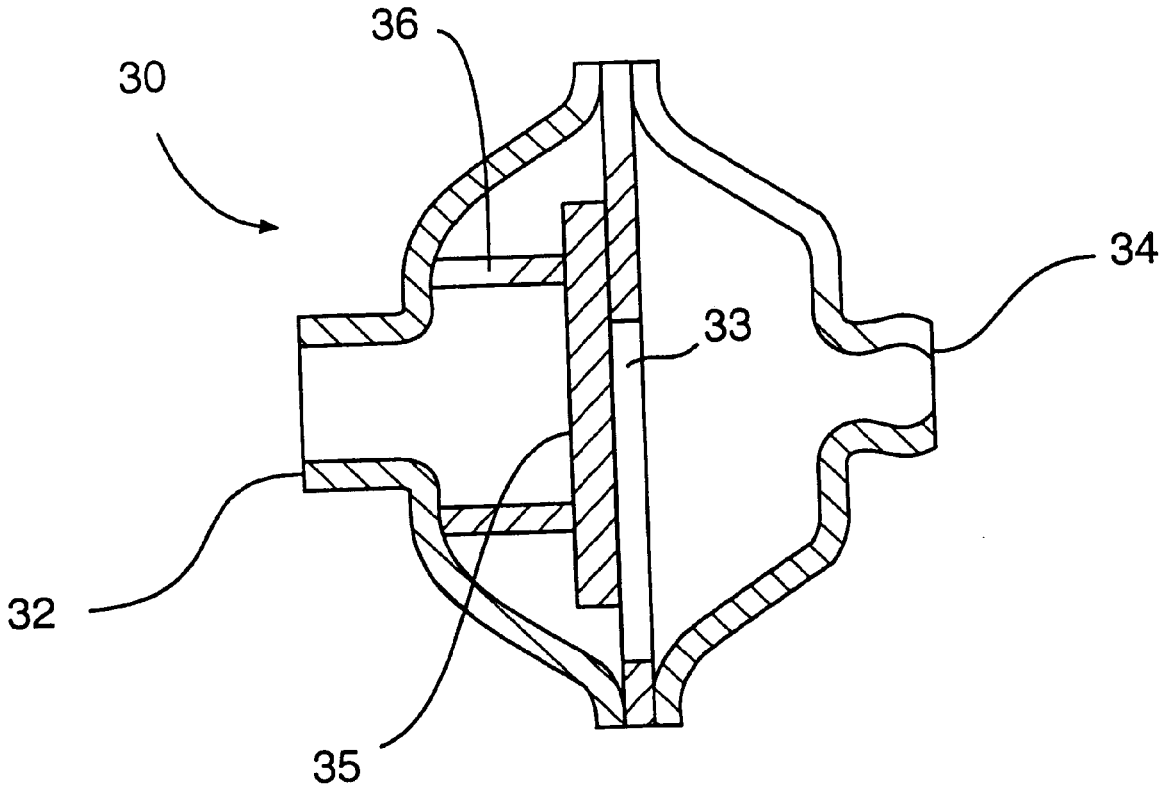
FIG. 3 is a cross sectional view of the one-way pressure relief valve of the present invention.

The one-way pressure relief valve 30 shown in FIG. 3 is known to those of ordinary skill in the art. The valve 30 comprises a valve seat 33 and a valve seal 35 for abutting the valve seat 33 and preventing the flow of air. In the system, the valve seal 35 is held in place by a spring 36 until a vacuum of sufficient force is created in the exhaust manifold 20 at which point the valve seal 35 separates from the valve seat 33, thereby allowing air at atmospheric pressure to enter past the valve seal 35 into the exhaust manifold 20.

The one-way pressure relief valve 30 is preferably connected to the exhaust manifold 20 at an internally threaded bore 28 which is defined in the wall 26 of the exhaust manifold 20. There is a double ended threaded bolt 70 having a first end 72 and a second end 74 which couples the valve 30 to the exhaust manifold 20. The first end 72 of the bolt 70 is adapted to engage the internally threaded bore 28 and the second end 74 of the bolt 70 is adapted to engage the first end 32 of the one-way pressure relief valve 30.

In operation of the marine engine 10, a vacuum is created in the exhaust manifold 20 due to the phenomena described above. This vacuum causes the exhaust section to draw in water and foreign water from the surrounding environment. To prevent the back flow or ingestion of the water and foreign matter into the cylinder head 12 and subsequently the valves and cylinders (not shown), the vacuum in the exhaust manifold 20 must be overcome. One way of overcoming the vacuum is to impart some positive pressure into the exhaust manifold 20, thereby breaking the vacuum and forcing the water and particulate matter out of the exhaust manifold 20 in the desired direction. When the pressure inside the exhaust manifold 20 is less than atmospheric pressure the one-way pressure relief valve 30 opens as described above and the pressure of the ambient air imparts the required positive pressure in the exhaust manifold 20 to overcome the vacuum (i.e. negative pressure).

The air inlet line 40, while serving as a conduit for the passage of atmospheric pressure to the one-way relief valve

30, also serves the purpose of preventing any exhaust from exiting the exhaust manifold 20 in an uncontrolled manner. For example, once the vacuum in the exhaust manifold 20 is overcome, there is a potential for a small amount of exhaust to exit through the valve 30 before it completely seals. The air inlet hose 40 is therefore preferably secured in such a manner that individuals operating the marine engine do not come into contact with the exhaust. As shown in FIGS. 1 and 2, the air intake line 40 is preferably slidably connected to a bracket 50 which is mounted to the flame arrestor 55 of the marine engine 10. The air inlet line 40 faces, but is separated from, the flame arrestor 55. This allows ambient air at atmospheric pressure to enter the air inlet line 40 while also allowing any exhaust gases to be safely expelled. The fact that the valve 30 does not bleed pressure from the intake manifold 11 prevents the combustion processes from being effected when the pressure in the exhaust system decreases. Additionally, since the exhaust manifold 20 relies on atmospheric pressure from the air inlet line 40 to break any vacuum created therein, and there is no chance for a vacuum to be created in the air inlet line 40, the vacuum in the exhaust riser can be overcome under any operating conditions.

It will be apparent to those skilled in the art that various modifications and variations can be made in the anti ingestion device of the present invention without departing from the spirit or scope of the invention. Thus, it is intended that the present invention covers the modifications and variations of this invention provided they come within the scope of the appended claims and their equivalents.

I claim:

1. An anti ingestion device, for use with a marine engine, for preventing the ingestion of water and foreign matter, comprising:

an exhaust manifold for exhausting engine gases, said exhaust manifold having a first end and a second end, wherein said first end is connected to a cylinder head;

a one-way pressure relief valve having a first end coupled to said exhaust manifold and a second end exposed to atmospheric pressure, wherein said one-way pressure relief valve remains closed unless the pressure in the exhaust manifold is less than atmospheric pressure;

an air inlet line coupled to said second end of said one-way pressure relief valve, such that said air inlet line serves as a conduit for guiding atmospheric pressure to said one-way pressure relief valve thereby providing atmospheric pressure for passage into said exhaust manifold.

2. The anti ingestion device of claim 1, wherein said air inlet line is slidably coupled to a bracket, said bracket being coupled to a flame arrestor on said engine such that said air inlet line faces, but is separate from, said flame arrestor.

3. The anti ingestion device of claim 1, further comprising:

an internally threaded bore defined in said exhaust manifold for receiving a threaded bolt having a first end and a second end, wherein said first end of said threaded bolt engages said exhaust manifold and said second end of said threaded bolt is adapted to engage said first end of said one-way pressure relief valve.

4. An anti ingestion device, for use with a marine engine, for preventing the ingestion of water and foreign matter, comprising:

an exhaust riser for exhausting engine gases, said exhaust riser having a first end and a second end, wherein said first end is connected to a cylinder head;

a one-way pressure relief valve having a first end coupled to said exhaust riser and a second end exposed to atmospheric pressure, wherein said one-way pressure relief valve remains closed unless the pressure in the exhaust riser is less than atmospheric pressure;

an air inlet line coupled to said second end of said one-way pressure relief valve, such that said air inlet line serves as a conduit for guiding atmospheric pressure to said one-way pressure relief valve thereby providing atmospheric pressure for passage into said exhaust riser.

5. The anti ingestion device of claim 4, wherein said air inlet line is slidably coupled to a bracket, said bracket being coupled to a flame arrestor on said engine such that said air inlet line faces, but is separate from, said flame arrestor.

6. The anti ingestion device of claim 4, further comprising:

an internally threaded bore defined in said exhaust riser for receiving a threaded bolt having a first end and a second end, wherein said first end of said threaded bolt engages said exhaust riser and said second end of said threaded bolt is adapted to engage said first end of said one-way pressure relief valve.

* * * * *